United States Patent [19]

Tanaka et al.

[11] Patent Number: 4,940,657

[45] Date of Patent: Jul. 10, 1990

[54] PHOTOGRAPHIC SPECTRAL SENSITIZING DYE

[75] Inventors: Akira Tanaka; Hidetoshi Miura; Masao Koga, all of Nagaokakyo, Japan

[73] Assignee: Mitsubishi Paper Mills Limited, Tokyo, Japan

[21] Appl. No.: 298,975

[22] Filed: Jan. 19, 1989

[30] Foreign Application Priority Data

Jan. 21, 1988 [JP] Japan ..... 63-12360

[51] Int. Cl.[5] ..... G03C 1/19; G03C 1/20; G03C 1/14; G03C 1/22

[52] U.S. Cl. ..... 430/578; 430/583; 430/584; 430/585; 430/586; 430/588; 430/590; 430/592; 430/595

[58] Field of Search ..... 430/578, 583, 584, 585, 430/588, 592, 590, 595, 586

[56] References Cited

U.S. PATENT DOCUMENTS

| | | | |
|---|---|---|---|
| 3,743,510 | 7/1973 | Nakazawa et al. | 430/578 |
| 3,769,024 | 10/1973 | Sakazume et al. | 430/583 |
| 4,172,730 | 10/1979 | Hinato et al. | 430/588 |
| 4,582,779 | 4/1986 | Kubota et al. | 430/592 |

*Primary Examiner*—Richard L. Schilling
*Attorney, Agent, or Firm*—Cushman, Darby & Cushman

[57] ABSTRACT

Disclosed is a photographic spectral sensitizing dye represented by the following formula (I), (II) or (III):

(I)

(II)

(III)

wherein $R_1$, $R_2$, $R_3$, $R_5$ or $R_7$ each represents an alkyl group, an aralkyl group or an alkenyl group, $R_4$ and $R_6$ each represents an alkyl group, aralkyl group, an alkenyl group or an aryl group, $L_1$–$L_{22}$ each represents a methine group, $Z_1$–$Z_4$ each represents a group of atoms necessary to form a 5- or 6-membered nitrogen-containing heterocyclic ring, $X_1^-$ and $X_2^-$ each represents an acid anion and l, m, n, p, q, r, s, t and u each represents an integer of 1 or 2.

Silver halide photographic emulsion containing the above sensitizing dye is also disclosed.

3 Claims, No Drawings

PHOTOGRAPHIC SPECTRAL SENSITIZING DYE

BACKGROUND OF THE INVENTION

The present invention relates to novel spectral sensitizing dyes and their use as sensitizer in photographic materials.

Silver halide photographic light sensitive materials are required to have high sensitivity in the specific wavelength regions depending on purpose of use. As one method to obtain such silver halide photographic light sensitive materials, it is well known to add various kinds of cyanine dyes or merocyanine dyes to silver halide photographic emulsion to very effectively enhance sensitivity of the emulsion in a specific wavelength region in a longer wavelength region than the sensitive wavelength region peculiar to the silver halide.

When dyes are added in silver halide photographic emulsion, they have not only spectral sensitization effect, but also the following requirements must be satisfied:

(1) Spectral sensitization should be proper optical regions. (2) Stable photographic properties should be maintained during storage of light sensitive materials. (3) Stain or fog due to residual dye added for spectral sensitization should not be retained after development treatment. (4) There should be no unfavorable interaction with other photographic additives.

Although there have been known many cyanine dyes and merocyanine dyes containing benzoxazole ring, a few of them satisfy the above requirements such as sensitizability and photographic properties.

SUMMARY OF THE INVENTION

Accordingly, the object of the present invention is to provide spectral sensitizing dyes for photography which satisfy the above-mentioned requirements.

DESCRIPTION OF THE INVENTION

The inventors have found that dyes represented by the following formula (I), (II) or (III) are excellent dyes which can attain the above object.

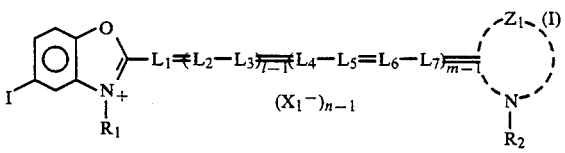

(I)

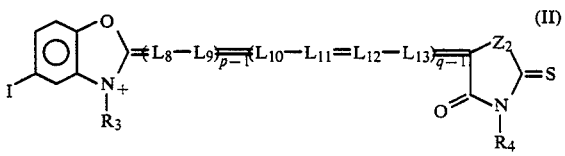

(II)

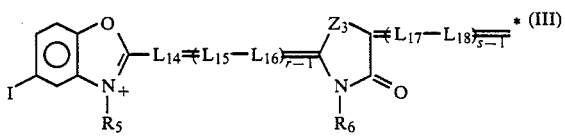

(III)

-continued

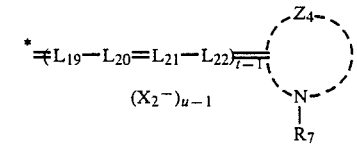

wherein $R_1$, $R_2$, $R_3$, $R_5$ and $R_7$ each represents an alkyl group (for example, lower alkyl groups such as methyl, ethyl, propyl and butyl, hydroxyalkyl groups such as β-hydroxyethyl and γ-hydroxypropyl, alkoxyalkyl groups such as β-methoxyethyl and γ-methoxypropyl, acyloxyalkyl groups such as β-acetoxyethyl, γ-acetoxypropyl and β-benzoyloxyethyl, carboxyalkyl groups such as carboxymethyl and β-carboxyethyl, alkoxycarbonylalkyl groups such as methoxycarbonylethyl, ethoxycarbonylmethyl and β-ethoxycarbonylethyl, and sulfoalkyl groups such as β-sulfoethyl, γ-sulfopropyl and δ-sulfobutyl), an aralkyl group (for example, benzyl, phenethyl, and sulfobenzyl) or an alkenyl group (for example, allyl) and $R_4$ and $R_6$ each represents said alkyl group, said aralkyl group, said alkenyl group or an aryl group (for example, phenyl, tolyl, methoxyphenyl, chlorophenyl, carboxyphenyl, sulfophenyl and naphthyl); $L_1$–$L_{22}$ each represents a methine group (which may be substituted with the above-mentioned alkyl group or aryl group or alkoxy group such as methoxy, ethoxy, propoxy or butoxy and further which may link to each other to form a 5- or 6-membered ring); $Z_1$–$Z_4$ each represents a group of atoms necessary to form a 5- or 6-membered nitrogen-containing heterocyclic ring and examples of $Z_1$ and $Z_4$ are oxazoline ring, oxazole ring, benzoxazole ring, benzoisoxazole ring, naphthoxazole ring, thiazoline ring, thiazole ring, benzothiazole ring, naphthothiazole ring, selenazoline ring, selenazole ring, benzoselenazole ring, naphthoselenazole ring, tellurazole ring, benzotellurazole ring, naphthotellurazole ring, pyridine ring, quinoline ring, benzoquinoline ring, indolenine ring, benzoindolenine ring, benzimidazole ring, naphthoimidazole ring and pyrroline ring and these heterocyclic rings, condensed benzene rings and naphthalene rings may have substituents such as alkyl groups (as mentioned-above), aryl groups (as mentioned-above), alkoxy groups (as mentioned-above), hydroxy group, carboxy groups, alkoxycarbonyl groups (such as methoxycarbonyl and ethoxycarbonyl), halogen atoms (such as fluorine, chlorine, bromine and iodine). Preferred examples of $Z_2$ and $Z_3$ are 2-thio-2,4-oxazolidinedione ring, 2-thio-2,4-imidazolidinedione ring, and 2-thio-2,4-thiazolidinedione ring; $X_1^-$ and $X_2^-$ each represents an acid anion (for example, alkylsulfate ions such as methylsulfate ion, and ethylsulfate ion, thiocyanate ion, toluenesulfonate ion, halogen ions such as chloride ion, bromide ion and iodide ion and perchlorate ion); and l, m, n, p, q, r, s, t and u each represents an integer of 1 or 2.

As is clear from the above explanation, the sensitizing dyes of the present invention are novel cyanine dyes, merocyanine dyes and rhodacyanine dyes which have the characteristic in molecular structure that benzoxazole ring is substituted with iodine atom at 5-position.

The inventors took a notice on unknown cyanine dyes, merocyanine dyes and rhodacyanine dyes whose benzoxazole ring is substituted with iodine at 5-position and have found that these dyes have superior photographic properties to those of other known halogen-substituted dyes. The reason is not clear, but it is supposed that such superior properties are due to electronic properties of iodine among halogens, difference in atomic radius and difference in ability of adsorption to the silver halide grains based on aggregation which relates to solubility of dye.

Typical examples of the sensitizing dyes represented by the above formulas are shown below.

Sensitizing dye (1)

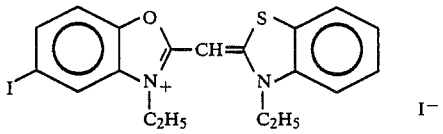

Sensitizing dye (2)

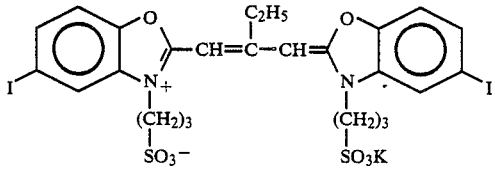

Sensitizing dye (3)

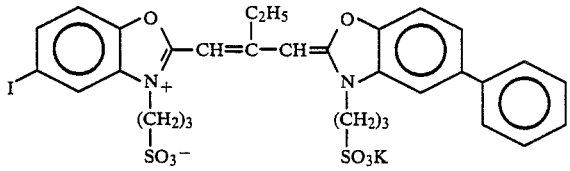

Sensitizing dye (4)

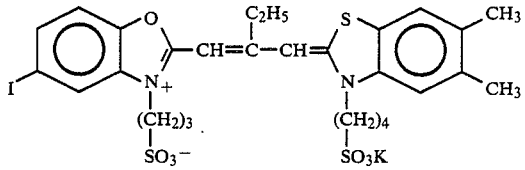

Sensitizing dye (5)

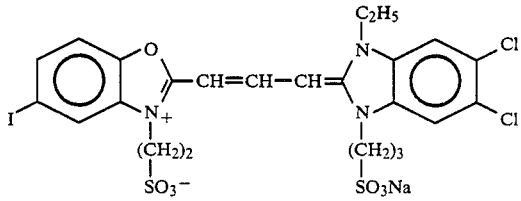

Sensitizing dye (6)

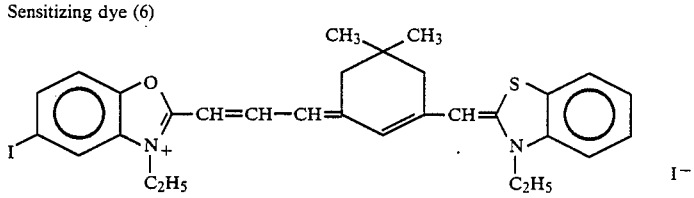

Sensitizing dye (7)

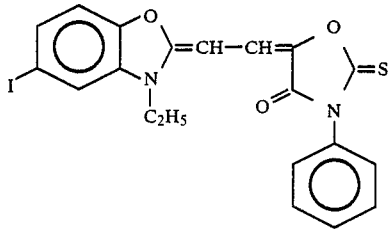

Sensitizing dye (8)

-continued
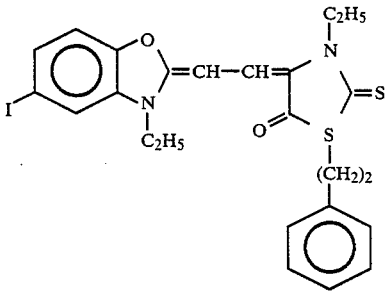
Sensitizing dye (9)
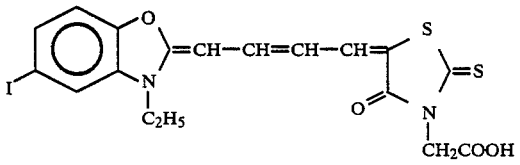
Sensitizing dye (10)
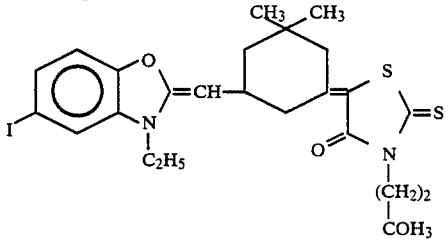
Sensitizing dye (11)
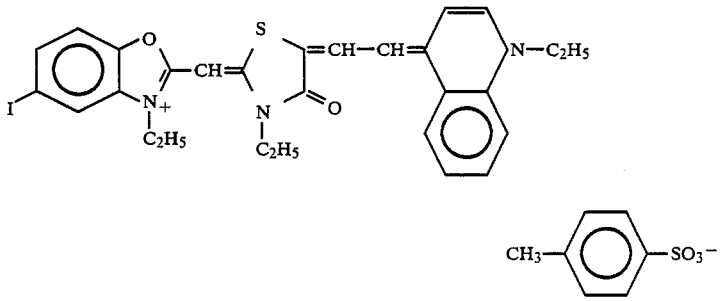
Sensitizing dye (12)
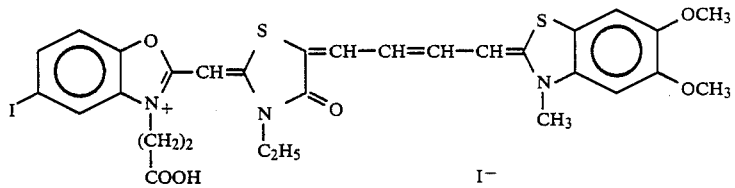
Sensitizing dye (13)
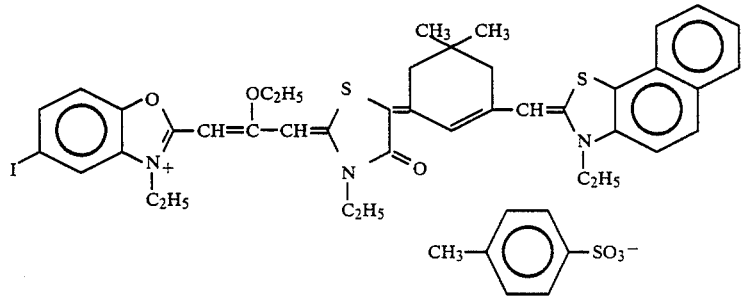

-continued

Sensitizing dye (14)

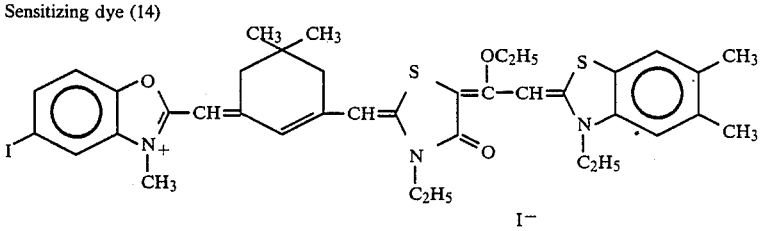

Sensitizing dye (15)

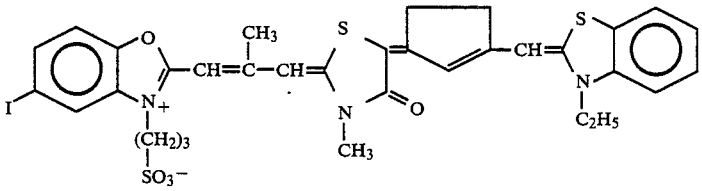

Typical preparation of the dyes represented by the above-mentioned formula are as follows.

Preparation of intermediate (A):

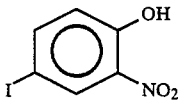

116 Grams of fuming nitric acid (specific gravity: 1.50) was mixed with 800 ml of acetic acid and a solution prepared by dissolving 200 g of 4-iodophenol in 1,200 ml of acetic acid was added dropwise to the above mixture over 1–2 hours at room temperature with stirring. Then, stirring was continued for 1 hour at room temperature. The resulting reaction mixture was poured on 2 liters of ice water and the precipitated solid was collected by filtration. The collected solid was washed with water and then was recrystallized from aqueous ethanol to obtain 148 g of a yellowish brown crystalline powder having a melting point of 85.5°–86.5° C.

Preparation of intermediate (B):

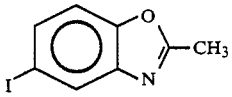

280 Grams of iron powder, 280 ml of dioxane and 280 ml of water were mixed and 56 ml of acetic acid was added dropwise to the mixture with stirring under heating at 85.0°–90.0° C., followed by further stirring under heating at the same temperature for 15 minutes. Then, thereto was added dropwise a solution of 145 g of the above-obtained 4-iodo-2-nitrophenol [intermediate (A)]in 560 ml of dioxane over 30–60 minutes. Then, the mixture was stirred for 1 hour at the same temperature and filtered with warming. Insoluble matters were washed with a small amount of warmed dioxane. Then the wash liquid was combined with the filtrate and the solvent was distilled off under reduced pressure. To the residue was added 600 ml of acetic anhydride, followed by refluxing under heating for 1 hour and elevating the temperature. Acetic anhydride was distilled off.

The residue was heated to higher than 200° C. for 2 hours and the acetic acid was distilled off. Then, the residue was distilled under reduced pressure. b.p. 105.0°–106.0° C./4 mmHg, 66.7 g (m.p. 47.0°–48.0° C.).

Preparation of intermediate (C):

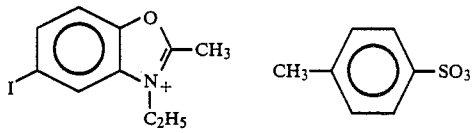

51 Grams of 5-iodo-2-methylbenzoxazole [intermediate (B)] and 39.4 g of ethyl p-toluenesulfonate were heated to 150.0°–155.0° C. on an oil bath for 4 hours. After cooling, the raw product was washed grinding with 120 ml of acetone and ether and dried, thus obtaining 77 g of a crystalline product, melting at 202.0°–204.5° C.

Preparation of intermediate (D):

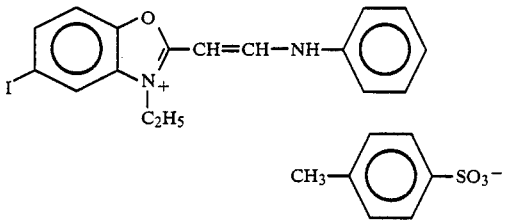

9.20 Grams of 3-ethyl-5-iodo-2-methylbenzoxazolium-p-toluenesulfonate [intermediate (C)] and 3.92 g of N,N'-diphenylformamidine were reacted at 150.0°–155.0° C. for 30 minutes. The mixture was then gently cooled and thereto was added 30 ml of hot water and well stirred and decanted. Thereto was added 20 ml of acetone to precipitate a crystal. The crystal was collected by filtration, washed with acetone and dried to obtain 3.09 g of a yellowish orange-colored powder of m.p. 283.0°–283.5° C.

Preparation of intermediate (E):

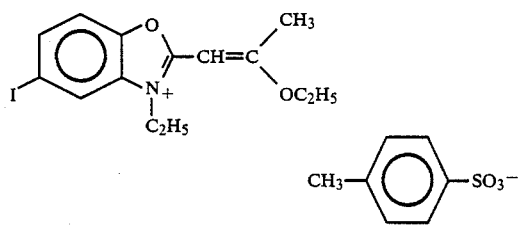

42.2 Grams of 3-ethyl-5-iodo-2-methylbenzoxazolium-p-toluenesulfonate [intermediate (C)] was dissolved in 33 ml of phenol with heating. To the solution was added 29.8 g of triethyl orthoacetate and the mixture was heated to 120.0°–125.0° C. for 15 minutes and washed with ether, followed by adding acetone thereto to precipitate a crystal. The crystal was collected by filtration, washed with acetone and recrystallized from isopropanol to obtain 17.8 g of a grayish white crystalline powder of m.p. 186.0°–187.0° C.

Preparation of sensitizing dye (2):

26.0 Grams of 5-iodo-2-methylbenzoxazole [intermediate (B)] and 12.2 g of 1,3-propanesultone were heated to 150.0°–155.0° C. for 4 hours. After cooling, the mixture was washed with ethyl ether and acetone.

Thereafter, 70 g of phenol was added and the mixture was heated to give a homogeneous liquid. Thereto were added 35.2 g of triethyl orthopropionate and 10.1 g of triethylamine and the mixture was heated to 120.0°–125.0° C. for 1.5 hour. After cooled to room temperature, the mixture was repeatedly washed with ether and then dissolved in 100 ml of ethanol with warming. To this solution was added a solution of 10 g of potassium acetate in 200 ml of ethanol. The precipitated crude dye was collected by filtration, washed with ethanol and then with methanol under heating and dried to obtain 6.2 g of an orange-colored powder of m.p. 262.0° C. (decomp.). Absorption maximum of methanolic solution thereof was 498 nm.

Preparation of sensitizing dye (6):

To 2.10 g of 2-anilinovinyl-3-ethyl-5-iodobenzoxazolium-p-toluenesulfonate [intermediate (D)] was added 5.0 ml of acetic anhydride. The mixture was refluxed under heating for 20 minutes. After cooled to room temperature, the mixture was repeatedly washed with ethyl ether to obtain a solid. To the solid were added 1.60 g of 3-ethyl-2-(3,5,5-trimethyl-2-cyclohexene-1-ylidenemethyl)benzothiazolium iodide and 20.0 ml of pyridine and 1.15 g of triethylamine was added to the mixture under reflux with heating. The resulting mixture was refluxed with heating for 5 minutes. After cooled to room temperature, ether was added and the precipitated crude dye was collected by filtration. The dye was washed with water, then recrystallized from ethanol and dried to obtain 1.0 g of a yellowish green crystalline powder having metallic luster and having m.p. of 224.5° C. (decomp.). Absorption maximum of a methanolic solution thereof was 727 nm.

Preparation of sensitizing dye (8):

8.0 milliliters of acetic anhydride was added to 2.24 g of 2-anilinovinyl 3-ethyl-5-iodobenzoxazolium-p-toluenesulfonate [intermediate (D)] and the mixture was refluxed under heating for 30 minutes. After nearly cooled, 1.00 g of 1-ethyl-3-phenethyl-2-thiohydantoin and 1.20 g of triethylamine were added and the mixture was heated at 95.0°–100.0° C. for 30 minutes. After cooled to room temperature, the precipitated crude dye was collected by filtration, washed with ethanol, recrystallized from ethyl acetate and dried to obtain 1.00 g of an orange-colored needle crystal of m.p. 258.0°–158.5° C. Absorption maximum of the methanolic solution thereof was 482 nm.

Preparation of sensitizing dye (11):

3.15 Grams of dimethyl sulfate was added to 1.70 g of 3-ethyl-5-[2-(1-ethyl-4-quinolinilidene)-ethylidene]rhodanine and the mixture was heated to 95.0°–100.0° C. for 7 minutes. After cooled to room temperature, the mixture was repeatedly washed with ethyl ether.

Thereto were added 2.30 g of 3-ethyl-5-iodo-2-methylbenzoxazolium-p-toluenesulfonate [intermediate (C)] and 35.0 ml of ethanol and 1.50 g of triethylamine was added to the mixture under reflux with heating and reflux was continued for 30 minutes. After cooled to room temperature, the precipitated crude dye was collected by filtration, washed with ethanol, recrystallized from methanol and dried to obtain 0.75 g of a purple crystalline powder having metallic luster and m.p. of 196.0° C. (decomp.). Absorption maxima of the methanolic solution thereof were 615 and 664 nm.

Preparation of sensitizing dye (13):

28.4 Grams of dimethyl sulfate was added to 22.2 g of 3-ethyl-5-[3-(3-ethyl-α-naphthothiazoline-2 ylidene)-methyl-5,5-dimethyl-2-cyclohexene-1-ylidene]-rhodanine and the mixture was heated at 95.0°–100.0° C. for 40 minutes. After cooled to room temperature, the mixture was repeatedly washed with ethyl ether. Thereto were added 26.3 g of 2-(2-ethoxypropenyl)-3-ethyl-5-iodobenzoxazolium-p-toluenesulfonate [intermediate (E)] and 450 nm of ethanol. 13.7 Grams of triethylamine was added to the mixture under reflux with heating, followed by refluxing with heating for 30 minutes. The precipitated crude dye was collected by filtration with warming, washed with ethanol and then with ethyl acetate, then recrystallized from methanol and dried to obtain 16.8 g of a greenish brown crystalline powder of m.p. 230.0° C. (decomp.). Absorption maxima of the methanolic solution thereof were 448 nm and 727 nm.

Silver halide emulsion in which the sensitizing dye represented by the above-mentioned formula of the present invention may be any of silver chloride, silver bromide, silver chlorobromide, silver iodobromide, silver chloroiodobromide and the like which are prepared by conventional methods.

The sensitizing dye of the present invention can be added to these silver halide emulsions as an aqueous solution or a solution in an organic solvent such as methanol, ethanol, acetone, Cellosolve, pyridine, dimethylformamide or the like which is optionally miscible with water or in a mixed solvent thereof.

The sensitizing dye may be added to the emulsion at any stage during preparation of the emulsion, but suitably is added just after completion of second ripening.

Addition amount of the sensitizing dye varies depending on its kind and kind of silver halide emulsion, but can be used in a wide range of about 4–1,200 mg per 100 g of the silver halide in terms of silver nitrate.

The silver halide emulsion in which the sensitizing dye of the present invention is used may be subjected to noble metal sensitization, sulfur sensitization or reduction sensitization or combination thereof or may contain a polyalkylene oxide compound.

The silver halide emulsion in which the sensitizing dye of the present invention is used may, if necessary, be subjected to spectral sensitization with other sensitizing dyes such as known cyanine and mercocyanine dyes in combination with the present sensitizing dye. The emulsion may further contain additives such as stabilizer, surfactant, hardner, fluorescent brightening agent, ultraviolet absorber, filter dye, anti-irradiation dye, antihalation dye, preservative, plastisizer, matting agent, and color coupler. Furthermore, when the emulsion is used for light sensitive materials to be subjected to activation processing, it may contain a developing agent or a precursor thereof.

As protective colloid for silver halide photographic emulsion in which the present sensitizing dye is used, mention may be made of gelatin, gelatin derivatives such as phthalated gelatin and malonated gelatin, cellulose derivatives, soluble starch and water-soluble polymers.

As supports on which the silver halide photographic emulsion containing the present sensitizing dye is coated, there may be used, for example, baryta paper, plastic-laminated paper, synthetic paper, and resin films such as cellulose triacetate and polyethylene terephthalate. If necessary, these supports may be provided with a subbing layer and antihalation layer.

The following nonlimiting examples further explain the present invention.

EXAMPLE 1

To silver bromide emulsions prepared by double jet method were respectively added 0.05% methanolic solutions of sensitizing dye (2) of the present invention and the following comparative sensitizing dyes (A), (B) and (C) and 0.25% methanolic solutions of sensitizing dye (8) of the present invention and the following comparative sensitizing dyes (D), (E) and (F) in such amounts as shown in Table 1 per g of silver halide in terms of silver nitrate.

These emulsions were kept in a bath of 40° C. for 45 minutes to stabilize the spectral sensitization action. Then, a predetermined amounts of a stabilizer, a surfactant and a hardener were added to the emulsions and these emulsions were coated on paper supports laminated with polyethylene, dried and left standing at 35° C. overnight. Then, these supports were cut into suitable size. The resulting test samples were exposed by ISO method. Then respective samples were developed with D-72 developer (developer supplied by Eastman Kodak Co.) at 20° C. for 90 seconds and then subjected to stopping, fixation, washing with water and drying to obtain strips having desired monochrome images. Density of the images was measured by MACHBETH TD-504 densitometer of Macbeth Corporation to determine sensitivity and fog. Standard point of optical density for determination of sensitivity was the point of 0.75 and the sensitivity was expressed by a relative value when sensitivity of sample which contained no sensitizing dye was taken to be 100. The results are shown in Table 1.

Comparative sensitizing dye (A)

-continued

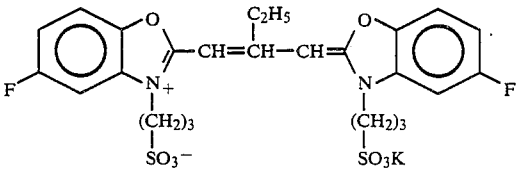

Comparative sensitizing dye (B)

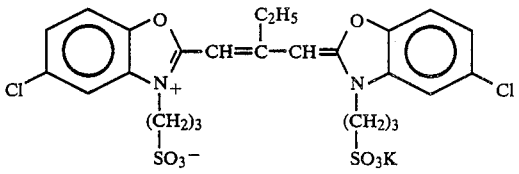

Comparative sensitizing dye (C)

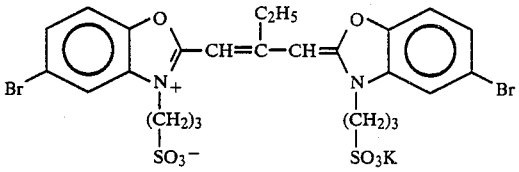

Comparative sensitizing dye (D)

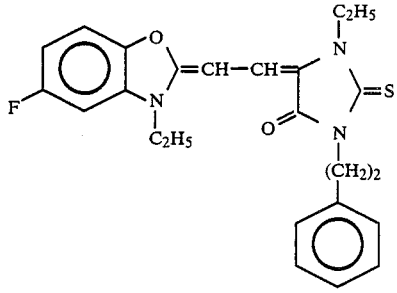

Comparative sensitizing dye (E)

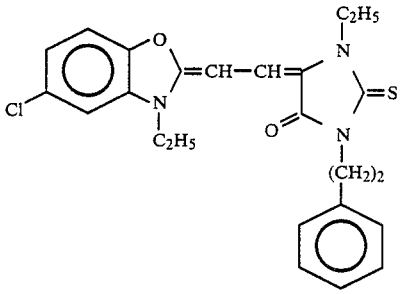

Comparative sensitizing dye (F)

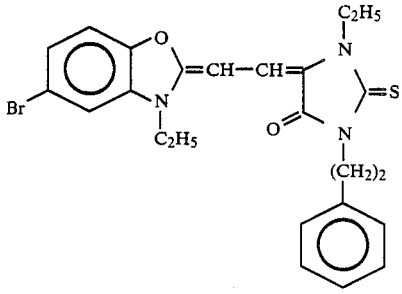

TABLE 1

| Sensitizing dye | Amount (ml) 0.4 Sensitivity | 0.4 Fog | 1.2 Sensitivity | 1.2 Fog | 3.6 Sensitivity | 3.6 Fog | Note |
|---|---|---|---|---|---|---|---|
| (2) | 235 | 0.06 | 398 | 0.06 | 759 | 0.06 | The present invention |
| (A) | 110 | 0.07 | 129 | 0.07 | 603 | 0.07 | Comparative example |
| (B) | 155 | 0.06 | 257 | 0.06 | 692 | 0.07 | " |
| (C) | 195 | 0.06 | 363 | 0.06 | 676 | 0.07 | " |
| (8) | 182 | 0.06 | 407 | 0.06 | 692 | 0.06 | The present invention |
| (D) | 115 | 0.07 | 224 | 0.07 | 102 | 0.07 | Comparative example |
| (E) | 105 | 0.06 | 186 | 0.07 | 347 | 0.07 | " |
| (F) | 174 | 0.06 | 347 | 0.06 | 617 | 0.07 | " |
| No addition | 100 | 0.06 | 100 | 0.06 | 100 | 0.06 | " |

As is clear from the results shown in Table 1, the sensitizing dyes of the present invention had higher sensitivity than the comparative sensitizing dyes and besides formed less fog. With addition amount of 3.6 ml, the comparative sensitizing dye (C) showed coloration in yellowish orange color while the sensitizing dyes of the present invention showed no coloration and no color stain.

methanolic solution. Red sensitivity was measured using Ratten Gelatin Filter No. 29 of Eastman Kodak Co.

White light sensitivity was expressed by relative value when sensitivity of sample containing no sensitizing dye was taken to be 100 and red sensitivity was expressed by relative value when red sensitivity of sample containing sensitizing dye (I) was taken to be 100.

The results are shown in Table 2.

Comparative sensitizing dye (G)

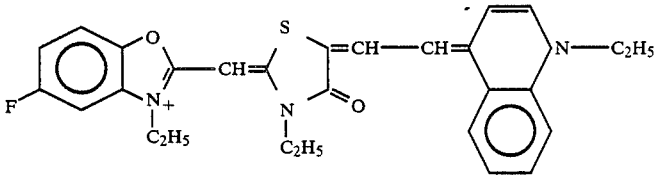

Comparative sensitizing dye (H)

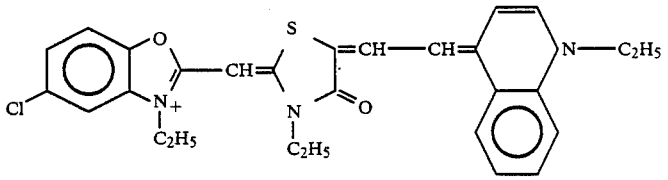

I⁻

Comparative sensitizing dye (I)

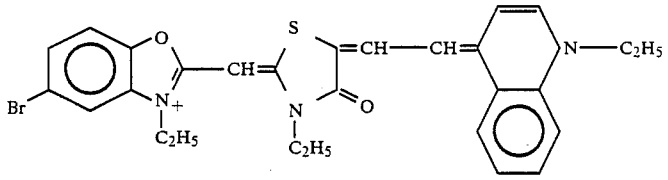

I⁻

EXAMPLE 2

Samples were prepared in the same manner as in Example 1 except that silver chloride was used as silver halide and the sensitizing dyes were used as 0.025%

TABLE 2

| Sensitizing dye | Amount (ml) 0.4 White light sensitivity | 0.4 Red sensitivity | 0.4 Fog | 1.2 White light sensitivity | 1.2 Red sensitivity | 1.2 Fog | Note |
|---|---|---|---|---|---|---|---|
| (11) | 725 | 126 | 0.07 | 912 | 144 | 0.08 | The present invention |
| (G) | 676 | 126 | 0.09 | 525 | 107 | 0.13 | Comparative example |
| (H) | 631 | 115 | 0.08 | 616 | 113 | 0.11 | " |
| (I) | 550 | 100 | 0.10 | 708 | 100 | 0.14 | " |
| No addition | 100 | — | 0.06 | 100 | — | 0.06 | |

EXAMPLE 3

Samples were prepared in the same manner as in Example 2 except that 3.0 ml (per 1 g of silver halide in terms of silver nitrate) of 0.01% solution of the sensitizing dye in dimethylformamide. A part of the sample (fresh one) was kept for 3 days under the conditions of 50° C. and 80% in relative humidity to make additional sample. Red sensitivity was measured by exposing the samples through Sharp Cut Filter SC-70 of Fuji Photo Film Co., Ltd. and expressed by relative value when red sensitivity of fresh sample containing sensitizing dye (K) was taken to be 100.

Comparative sensitizing dye (J)

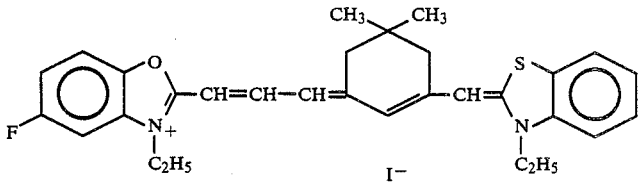

Comparative sensitizing dye (K)

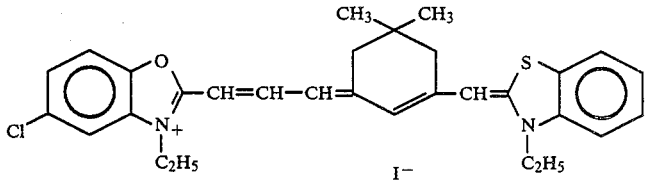

Comparative sensitizing dye (L)

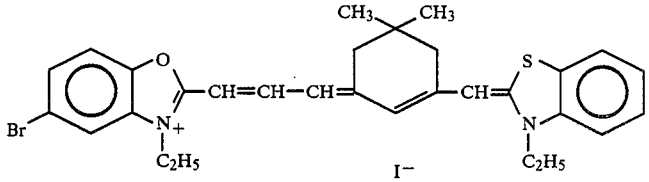

Comparative sensitizing dye (M)

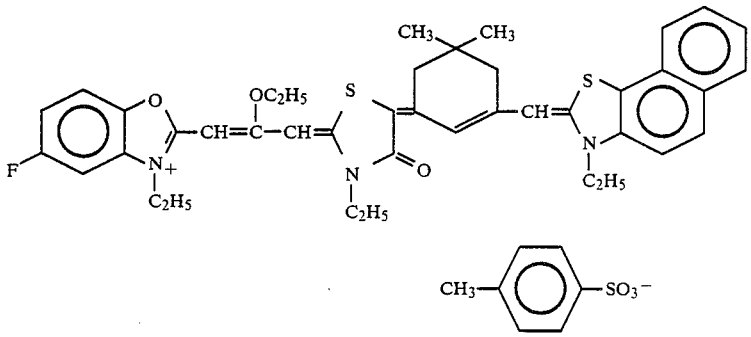

Comparative sensitizing dye (N)

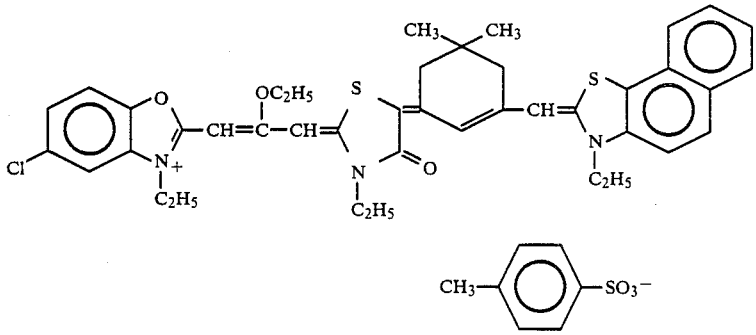

Comparative sensitizing dye (O)

-continued

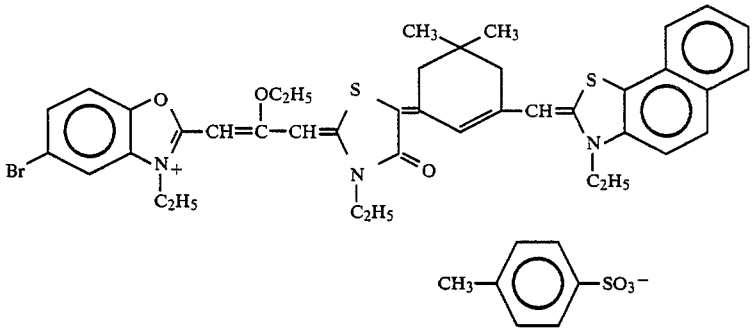

Comparative sensitizing dye (P)

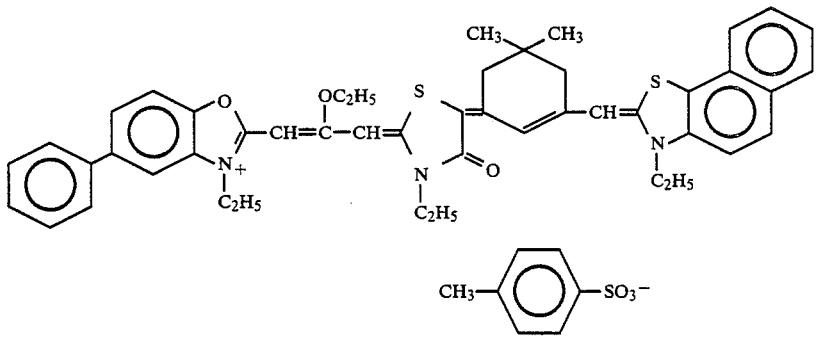

Comparative sensitizing dye (Q)

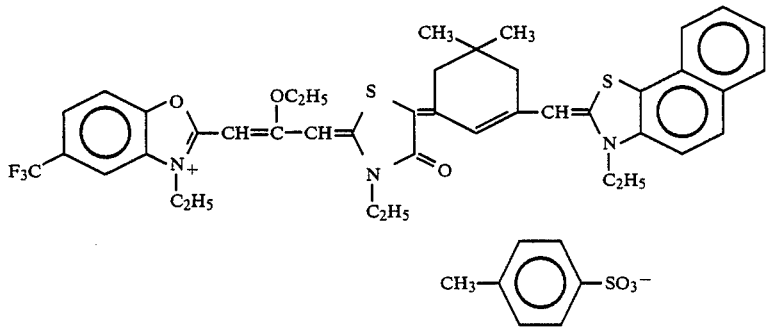

TABLE 3

| Sensitizing dye | Fresh sample Red sensitivity | Fresh sample Fog | Thermo-treated sample Red sensitivity | Thermo-treated sample Fog |
|---|---|---|---|---|
| (6) | 194 | 0.07 | 240 | 0.08 |
| (J) | 123 | 0.08 | 204 | 0.08 |
| (K) | 100 | 0.07 | 145 | 0.09 |
| (L) | 112 | 0.07 | 195 | 0.08 |
| (13) | 1000 | 0.10 | 1115 | 0.14 |
| (M) | —* | 0.57 | —* | 0.67 |
| (N) | 276 | 0.10 | 708 | 0.16 |
| (O) | 795 | 0.12 | 1110 | 0.17 |
| (P) | 525 | 0.10 | 1000 | 0.16 |
| (Q) | 229 | 0.07 | 676 | 0.14 |

*Measured value had no reliability because of high fog value.

As is clear from the above, the sensitizing dyes of the present invention show superiority to the comparative sensitizing dyes in sensitivity and fog. Furthermore, with reference to samples kept for 3 days at 50° C. and 80% RH, the samples of the present invention were less in change of sensitivity and fog and were superior.

What is claimed is:

1. A silver halide photographic emulsion which comprises a silver halide and a spectral sensitizing dye consisting essentially of at least one of the following compounds:

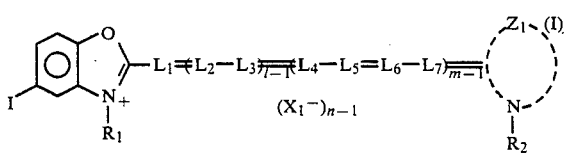

(I)

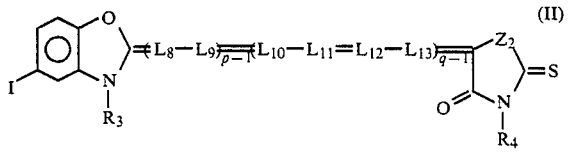

(II)

-continued

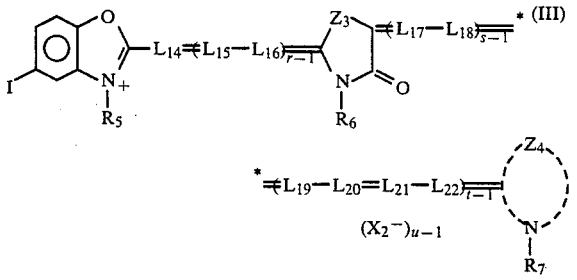

(III)

wherein $R_1$, $R_2$, $R_3$, $R_5$ or $R_7$ each represents an alkyl group, an aralkyl group or an alkenyl group, $R_4$ and $R_6$ each represents an alkyl group, aralkyl group, alkenyl group or aryl group, $L_1$–$L_{22}$ each represents a methine group, $Z_1$–$Z_4$ each represents a group of atoms necessary to form a 5- or 6-membered nitrogen-containing heterocyclic ring, $X_1^-$ and $X_2^-$ each represents an acid anion and l, m, n, p, q, r, s, t and u each represents an integer of 1 or 2.

2. A silver halide photographic emulsion according to claim 1 wherein amount of the spectral sensitizing dye is about 4–1,200 mg per 100 g of the silver halide in terms of silver nitrate.

3. A silver halide photographic light sensitive element which comprises a support and, provided thereon, a layer containing the silver halide photographic emulsion of claim 1.

* * * * *